US009783212B2

(12) United States Patent
Gibney et al.

(10) Patent No.: US 9,783,212 B2
(45) Date of Patent: Oct. 10, 2017

(54) INLET CLOSURE SYSTEM

(71) Applicant: Drax Power Limited, Selby, Northy Yorkshire (GB)

(72) Inventors: Richard Peter Gibney, Derby (GB); Stephen John Jones, Derby (GB); Jonathan James Barlow, Derby (GB)

(73) Assignee: Drax Power Limited, Selby, Yorkshire (GB)

( * ) Notice: Subject to any disclaimer, the term of this patent is extended or adjusted under 35 U.S.C. 154(b) by 135 days.

(21) Appl. No.: 14/768,669

(22) PCT Filed: Feb. 18, 2014

(86) PCT No.: PCT/GB2014/050474
§ 371 (c)(1),
(2) Date: Aug. 18, 2015

(87) PCT Pub. No.: WO2014/128452
PCT Pub. Date: Aug. 28, 2014

(65) Prior Publication Data

US 2016/0001792 A1 Jan. 7, 2016

(30) Foreign Application Priority Data

Feb. 19, 2013 (GB) ..... 1302893.1

(51) Int. Cl.
*B61D 3/00* (2006.01)
*B61D 39/00* (2006.01)

(52) U.S. Cl.
CPC ..... *B61D 39/001* (2013.01); *B61D 3/00* (2013.01); *B61D 39/006* (2013.01)

(58) Field of Classification Search
CPC ..... B61D 39/001; B61D 39/006; B61D 3/00
See application file for complete search history.

(56) References Cited

U.S. PATENT DOCUMENTS 2,408,132 A * 9/1946 Weeks ..... B60J 7/141 220/263
5,311,824 A * 5/1994 Sauer ..... B61D 7/00 105/377.01

(Continued)

FOREIGN PATENT DOCUMENTS

CN 202703597 U 1/2013
WO 2014128452 A1 8/2014

OTHER PUBLICATIONS

International Search Report dated Jun. 16, 2014 in connection with related International Patent App. No. PCT/GB2014/050474, 5 pages.

(Continued)

*Primary Examiner* — Jason C Smith
(74) *Attorney, Agent, or Firm* — Gesmer Updegrove LLP

(57) ABSTRACT

The invention relates to an inlet closure system for covering an inlet formed in an upper region of a container body The container body may a storage region of a hopper, a hopper vehicle such as a hopper railway wagon or other storage devices. The inlet closure system comprises at least one closure member arranged substantially above the inlet and moveable between a first closed configuration in which the inlet is substantially closed and a second fully open configuration in which the inlet is substantially open, and at least one actuator mounted on an end wall of the container body for moving the closure member. The actuator remains below an upper edge of the end wall when the closure member is in the second fully open configuration. The actuator is arranged in use to act upon the at least one closure member via a linkage, which linkage is arranged for pivotal motion relative to the end wall about a point substantially midway between the side walls. The linkage may comprise a first link and a second link. The second link may have a first and a second limb which meet at a non-straight angle.

(Continued)

Preferably, the first limb and/or the second link lie below the upper edge of the end wall when the closure member is in the second fully open configuration. The second limb may lie substantially beyond an inward facing surface of the closure member when the closure member is in the second fully open configuration. If two actuators are arranged to act upon respective closure members, the first links of the linkages are arranged to pivot about a common pivot point. The common pivot point is preferably located on the end wall at a point substantially midway between the sidewalls.

27 Claims, 10 Drawing Sheets

(56) References Cited

U.S. PATENT DOCUMENTS 6,402,224 B1 * 6/2002 Monaco ..... B60J 7/141
296/100.06
7,264,296 B1 * 9/2007 Maney ..... B60P 3/226
105/377.09
2005/0127705 A1 * 6/2005 Morrow ..... B60J 7/1621
296/100.1
2012/0048140 A1 * 3/2012 Dial ..... B61D 39/001
105/377.05
2014/0013994 A1 * 1/2014 Vande Sande ..... B61D 39/001
105/377.02
2015/0375761 A1 * 12/2015 Gibney ..... B61D 39/001
105/377.05
2016/0001792 A1 * 1/2016 Gibney ..... B61D 39/001
105/377.06

OTHER PUBLICATIONS

International Preliminary Report on Patentability dated Aug. 25, 2015 in connection with related International Patent App. No. PCT/GB2014/050474, 6 pages.

* cited by examiner

INLET CLOSURE SYSTEM

PRIORITY INFORMATION

The present invention is a continuation of PCT Application No. PCT/GB2014/050474 filed Feb. 18, 2014, that claims priority to GB Application No. 1302893.1, filed on Feb. 19, 2013, both of which are incorporated herein by reference in their entireties.

FIELD OF INVENTION

The present invention relates to an inlet closure system for a storage container and is concerned particularly, although not exclusively, with an inlet closure system for a covered hopper wagon.

BACKGROUND TO THE INVENTION

A hopper wagon is a type of freight railway vehicle for transporting bulk commodities. Typically the bulk commodity is held in a generally box-shaped hopper wagon body that is supported by an under-frame. The underframe may be coupled to bogies so that the hopper wagon can be moved along a railway track.

The bulk commodity may be loaded into the hopper wagon body through an inlet aperture at the top of the wagon body, and may be discharged through an outlet aperture at the bottom of the wagon body. In covered hopper wagons, the inlet is provided with a cover to protect the bulk commodity held in the hopper wagon body.

The cover may comprise a simple removable sheet. However, this type of cover system must be operated manually, and has the further disadvantage that the sheet must be stored when it is not in use. Other cover systems include one or more doors that can be moved between open and closed configurations in a sliding or rotating action. Advantageously, the doors of these types of cover system remain attached to the hopper wagon body during use and may be driven to slide or rotate using an automatic, or semi-automatic, actuating system.

The doors are typically arranged as an opposing pair of door leaves that are hingedly mounted at their proximal edges on longitudinal side walls of the wagon body and rotate about substantially horizontal axes between an open configuration, in which the doors extend generally upwards away from the open top of the wagon body, and a closed configuration, in which doors extend towards each other generally across the top of the wagon body to substantially cover the inlet as their distal edges engage each other.

In automatic, or semi-automatic, systems pneumatic or hydraulic actuators are arranged to move the doors between the open and closed configurations. Each door has a pair of actuators that are typically mounted on opposed end walls of the wagon. Piston rods of the actuators act directly upon frame members of the doors.

One disadvantage of this design is that when the doors are fully open, such as during the loading of the wagon, the piston rods project above the end walls of the wagon body. As a result, the piston rods may impair access to the inlet, conflict with a loading chute and impede the loading of the bulk commodity. The piston rods may be vulnerable to damage from inadvertent contact with the loading chute and/or with the bulk commodity material itself during the loading process. Such damage, if it occurs, can be costly as the cylinder must be replaced.

Embodiments of the invention seek to provide an alternative and improved inlet closure system. Embodiments of the present invention aim to address the disadvantages of the previously considered inlet closure systems.

SUMMARY OF THE INVENTION

The present invention is defined in the attached independent claims, to which reference should now be made. Further, preferred features may be found in the sub-claims appended thereto.

A first aspect of the invention relates to an inlet closure system for covering an inlet formed in an upper region of a container body having side walls and at least one end wall.

The inlet closure system comprises:

at least one closure member arranged substantially above the inlet and moveable between a first closed configuration in which the inlet is substantially closed and a second fully open configuration in which the inlet is substantially open, and at least one actuator mounted on the end wall of the container body for moving the closure member, wherein the actuator remains below an upper edge of the end wall when the closure member is in the second fully open configuration, and wherein the actuator is arranged in use to act upon the at least one closure member via a linkage, which linkage is arranged for pivotal motion relative to the end wall about a point substantially midway between the side walls. The container body may be any suitable storage chamber. For example, the container body may be a hopper, hopper vehicle or an inter-modal container box.

Preferably the actuator is arranged to remain below the upper edge of the end wall throughout substantially the full range of movement of the closure member.

The linkage preferably comprises first and second links.

The first link may be arranged for pivotal motion relative to the end wall.

The second link may comprise first and second limbs which meet at a non-straight angle, and preferably meet at an angle of ninety degrees or more.

The actuator may comprise a piston rod. The piston rod may be arranged to remain below the upper edge of the end wall throughout substantially the full range of movement of the closure member. The piston rod is preferably connected pivotally to the second link, and more preferably is connected pivotally to the second link substantially at an end of one of the limbs thereof.

In a preferred arrangement when the closure member is in the second fully open configuration the first limb of the second link is arranged to lie below the upper edge of the end wall. Preferably in this configuration, the second limb of the second link is arranged to lie substantially beyond an inward facing surface of the closure member.

The piston rod may be connected to the first link. Preferably the piston rod is connected to the first and second links at a common pivot.

In a particularly preferred arrangement the piston rod is connected to a first end of the first link and to a first end of the second link at a common pivot, a second end of the second link is connected to the closure member and a second end of the first link is pivotally connected to a mounting point on the end wall.

When the closure member is in the second, fully open configuration the first link is preferably arranged to lie below the upper edge of the end wall.

The arrangement of the actuator and linkage when the closure member is in the second fully open configuration advantageously prevents the actuator and linkage from forming an obstruction or impediment above the inlet. As a consequence, the arrangement aids the loading process of bulk commodities. The arrangement also helps to protect the actuator and linkage from damage and thereby improves the operational lifetime of the inlet closure system.

Preferably the closure member has a proximal edge which is mounted by a hinge on the side wall in the region of an upper edge of the side wall.

Preferably there are two closure members, each mounted on one of the opposed side walls along a proximal edge and arranged to meet at their distal edges to close the inlet.

One of the closure members may comprise a seal along its distal edge, wherein the seal is arranged to extend over the distal edge of the other closure member in the closed configuration.

Two actuators are preferably mounted on the end wall, each being arranged in use to move one of the closure members.

Preferably the two actuators are each arranged to act upon a respective one of the closure members via a linkage. More preferably the first links of the two linkages are arranged to pivot about a common pivot point. The common pivot point of the two first links is preferably located on the end wall at a point substantially mid-way between the side walls.

In a particularly preferred arrangement the end wall comprises a substantially upright support member arranged mid-way between the side walls and preferably generally parallel thereto. The common pivot point of the two first links may be located on the support member.

The substantially upright support member, which may be included to improve the structural strength of the wagon body, may advantageously provide the common pivot for the ends of the first links of the two linkages, thereby obviating the need for an additional sub-frame on which to mount the linkages on the end wall, along with the undesirable extra mass that this would add to the wagon body.

In a preferred arrangement the body has two opposed end walls. Preferably the or each closure member extends substantially between the opposed end walls of the body. A first pair of actuators may be mounted on a first end wall and arranged to move one of the closure members, and a second pair of actuators may be mounted on a second, opposing end wall and arranged in use to move the other one of the closure members.

The or each actuator may comprise a pneumatic actuator. Alternatively, or in addition the or each actuator may comprise a hydraulic actuator.

The or each actuator may comprise one or more blocking valves arranged in use to control its operation.

The system may be controlled manually, semi-automatically or automatically. When the system is arranged for semi-automatic or automatic operation the opening and/or closing of the or each closure member may be triggered by one or more sensors detecting the presence of a local device, which may comprise a magnet.

The invention may include any combination of the features or limitations referred to herein, except such a combination of features as are mutually exclusive, or mutually inconsistent.

BRIEF DESCRIPTION OF THE DRAWINGS

For a better understanding of the present invention and to show how it may be carried into effect, a preferred embodiment of the present invention will now be described. By way of example only, with reference to the accompanying diagrammatic drawings, in which.

DETAILED DESCRIPTION OF THE INVENTION

The invention relates to an inlet closure system for covering an inlet formed in an upper region of a container body. The container body may be a storage region of a storage device such as a hopper, hopper vehicle or intermodal container box.

Figure 1:
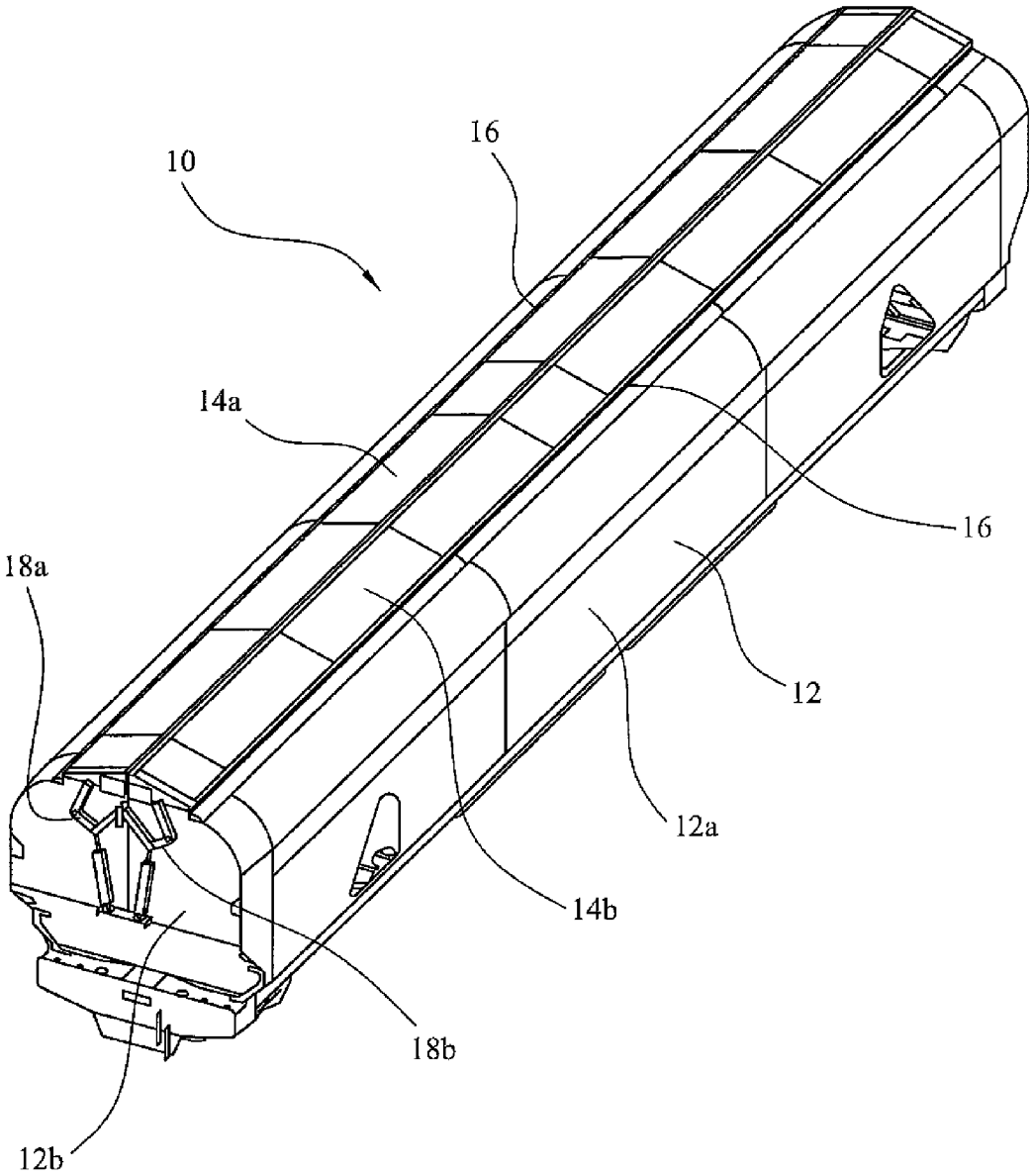
FIG. 1 is a schematic perspective view of a covered hopper wagon having an inlet closure system according to an embodiment of the present invention, with the inlet doors being in a first, closed position.
Figure 2:
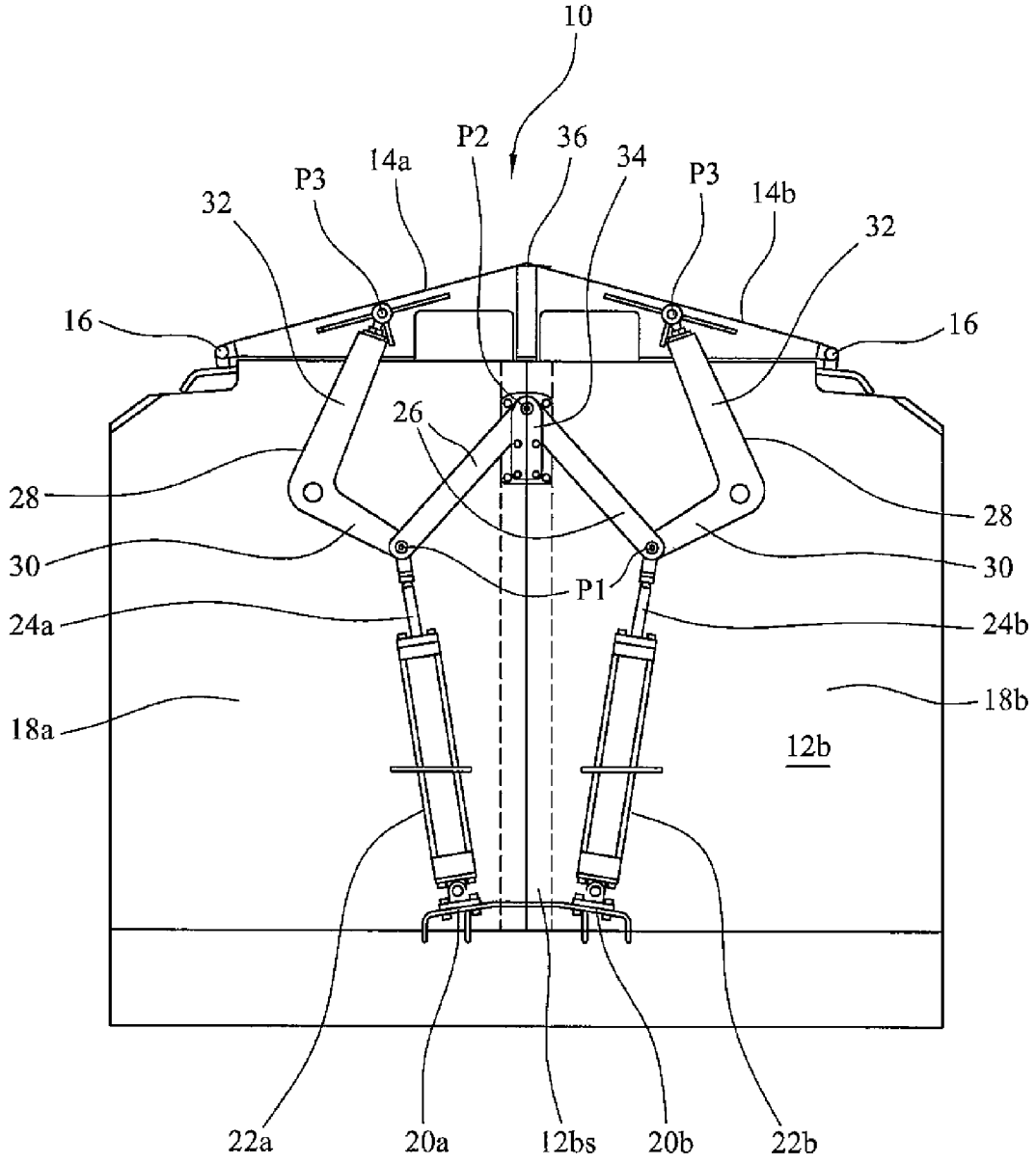
FIG. 2 is a schematic end view of the wagon of FIG. 1.

FIGS. 1 and 2 show a closed hopper rail wagon (10) for use in transporting bulk freight. The wagon comprises an elongate wagon body (12) of steel, comprising sidewalls (12*a*) and end walls (12*b*), defining an enclosure within (not shown in FIGS. 1 and 2) for containing a bulk commodity. The wagon comprises an inlet (I) formed in the top of the body. The inlet has a generally rectangular shape and it is defined by upper edges of the sidewalls and the end walls. The wagon further comprises outlets formed in the bottom of the body (not shown). The body (12) is supported on an under-frame (not shown). Beneath the under-frame is a pair of bogies (not shown), for engagement with a railway track in use. The bogies have been omitted from these drawings in the interests of simplicity.

At an upper region of the body 12 a pair of openable doors 14*a* and 14*b* extend substantially the entire length of the wagon. The doors 14*a* and 14*b* are mounted at their proximal edges by hinges 16 and they meet at their distal edges to form a closure across the inlet (I). In FIGS. 1 and 2 the doors are shown in a closed configuration. Hence, any bulk commodities stored within the body are at least substantially concealed within the wagon.

At a lower region of the body 12 outlet doors (not shown) are provided to facilitate the discharge of a bulk commodity from the wagon.

At each of two opposed ends of the wagon are located two double-acting pneumatic actuators, generally at 18*a* and 18*b*, which are described in detail below. The actuation apparatus at the opposed ends are substantially identical, and accordingly description of one end, shown in detail in FIG. 2, is deemed sufficient. The actuators act in pairs, one actuator at each end, on one of the doors.

With particular reference to FIG. 2, the actuators 18*a* and 18*b* each comprise a cylinder mount 20*a*, 20*b* mounting a cylinder 22*a*, 22*b*, a piston (not shown), a piston rod 24*a*, 24*b*. Linkages (26, 28) interconnect the respective actuators 18*a*, 18*b* and the doors 14*a*, 14*b* so as to transmit force from the actuators to the respective doors.

The linkages each comprise a first, straight link 26 and a second, substantially L-shaped, or banana-shaped, link 28 pivotally connected together at pivot P1. The L-shaped link comprises first and second integrally formed limbs 30 and 32 that meet at a non-straight angle, which in this case is between ninety and one hundred degrees. In each case a first end of the straight link is connected to a first end of the L-shaped link at pivot P1, which is also where the piston rod connects to the linkages. The straight link is connected at its second end to a common linkage mounting 34 by a second pivot P2. The common linkage mounting 34 is advantageously attached to an upright structural support member 12*bs* on the inside of the end wall 12*b*, shown in broken lines in FIG. 2. The L-shaped link 28 is connected at its second end to the door by a pivot P3.

In FIGS. 1 and 2 the piston rods 24*a*, 24*b* are shown fully retracted into their respective cylinders 22*a*, 22*b*. As a result, the doors 14*a* and 14*b* are in the fully closed 10 configuration, and in this position a weather seal 36, attached to the distal edge of door 14*a*, extends over the distal edge of door 14*b*, in order to protect against the ingress of water between the doors.

Because of the presence of the weather seal 36 the opening and closing of the doors 14*a* and 14*b* must take place in a specific sequential order, as will now be described with reference to the remaining figures. However, in an alternative design, the opening and closing of the doors may take place simultaneously.

Figure 3A:
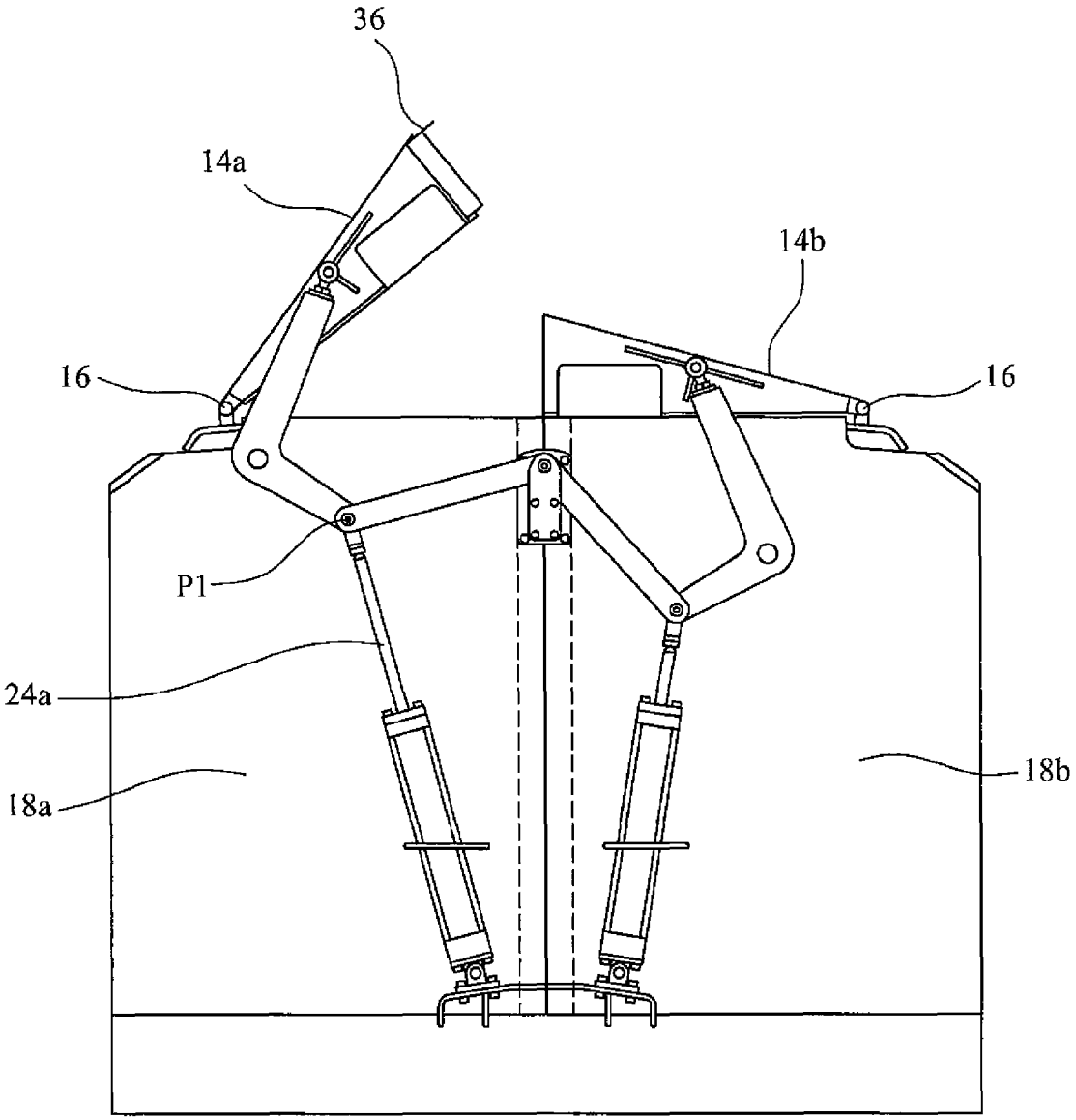
FIGS. 3*a* and 3*b* show the wagon of FIG. 1 respectively in end view and schematic perspective view, with one of the doors in an intermediate position.
Figure 3B:
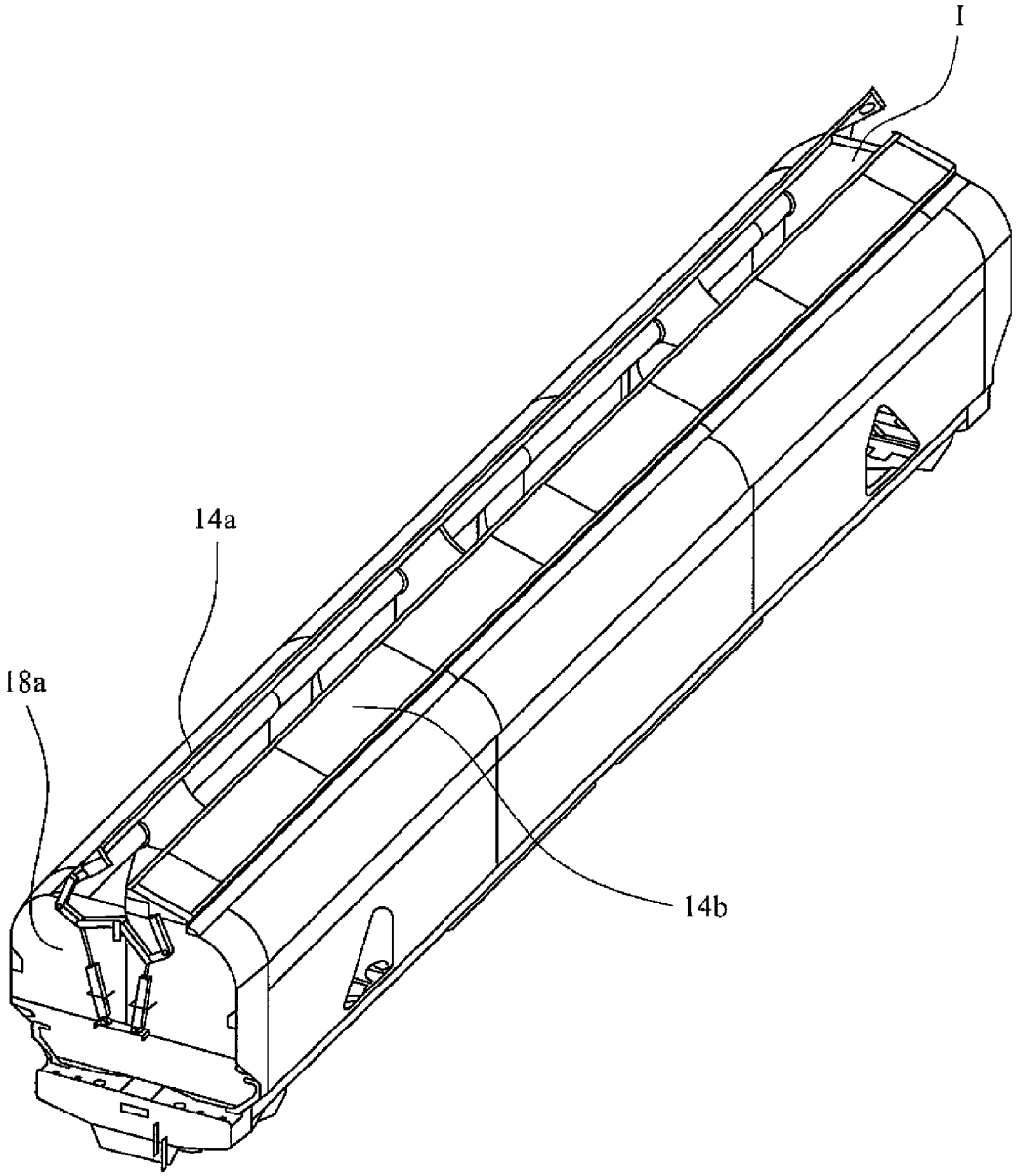

Turning to FIGS. 3*a* and 3*b*, these show an initial stage of opening the doors 14*a* and 14*b*, in which pneumatic actuator 18*a* has operated to extend piston rod 24*a* to the position shown. As a result pivot P1 has been lifted and door 14*a* has been raised clear of door 14*b* on its hinge 16. Door 14*a* must rise before door 14*b* because of the presence of the weather seal 36 on door 14*a*.

Figure 4A:
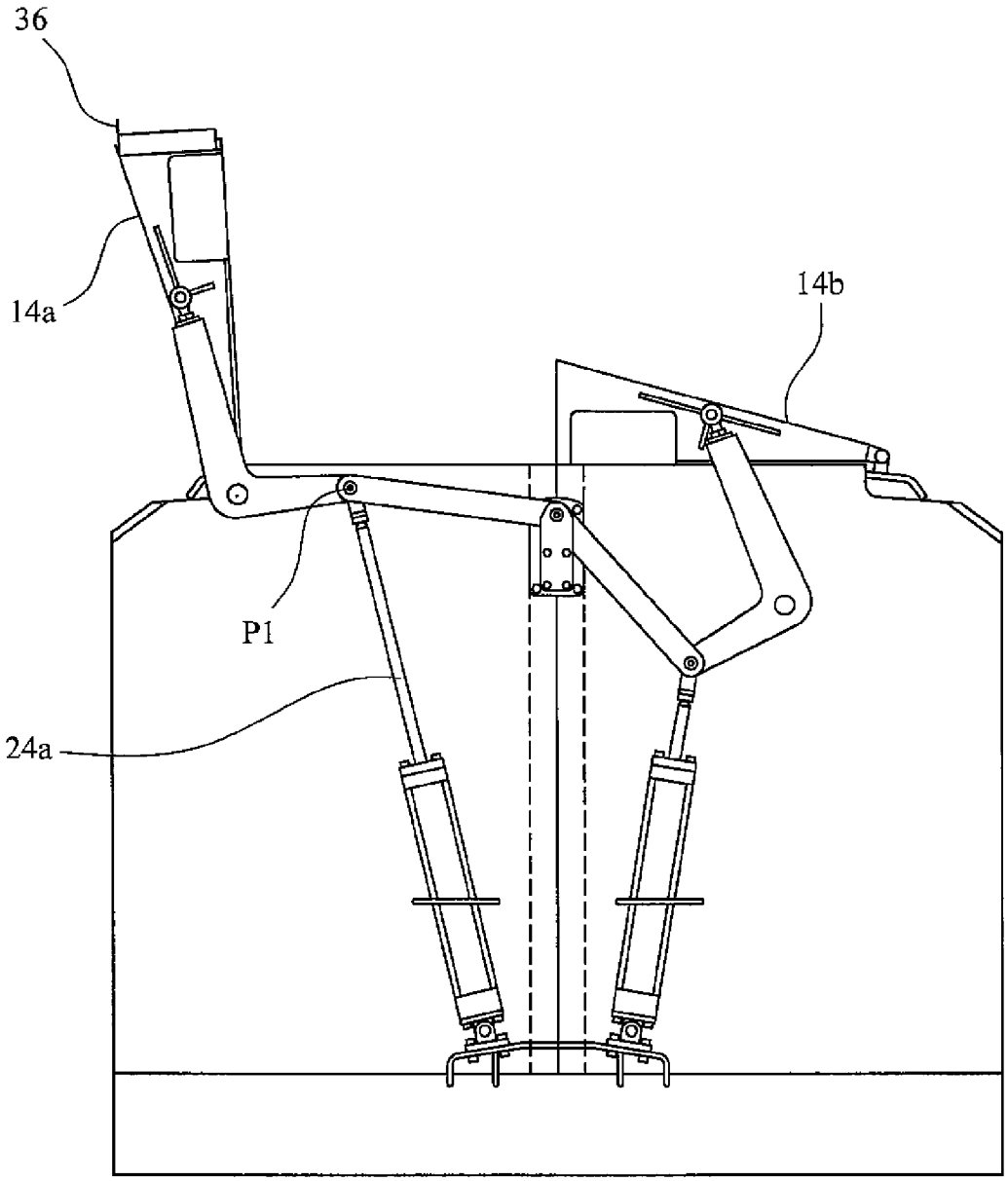
FIGS. 4*a* and 4*b* show the wagon of FIG. 1 respectively in end view and schematic perspective view with one of the doors in a fully open position.
Figure 4B:
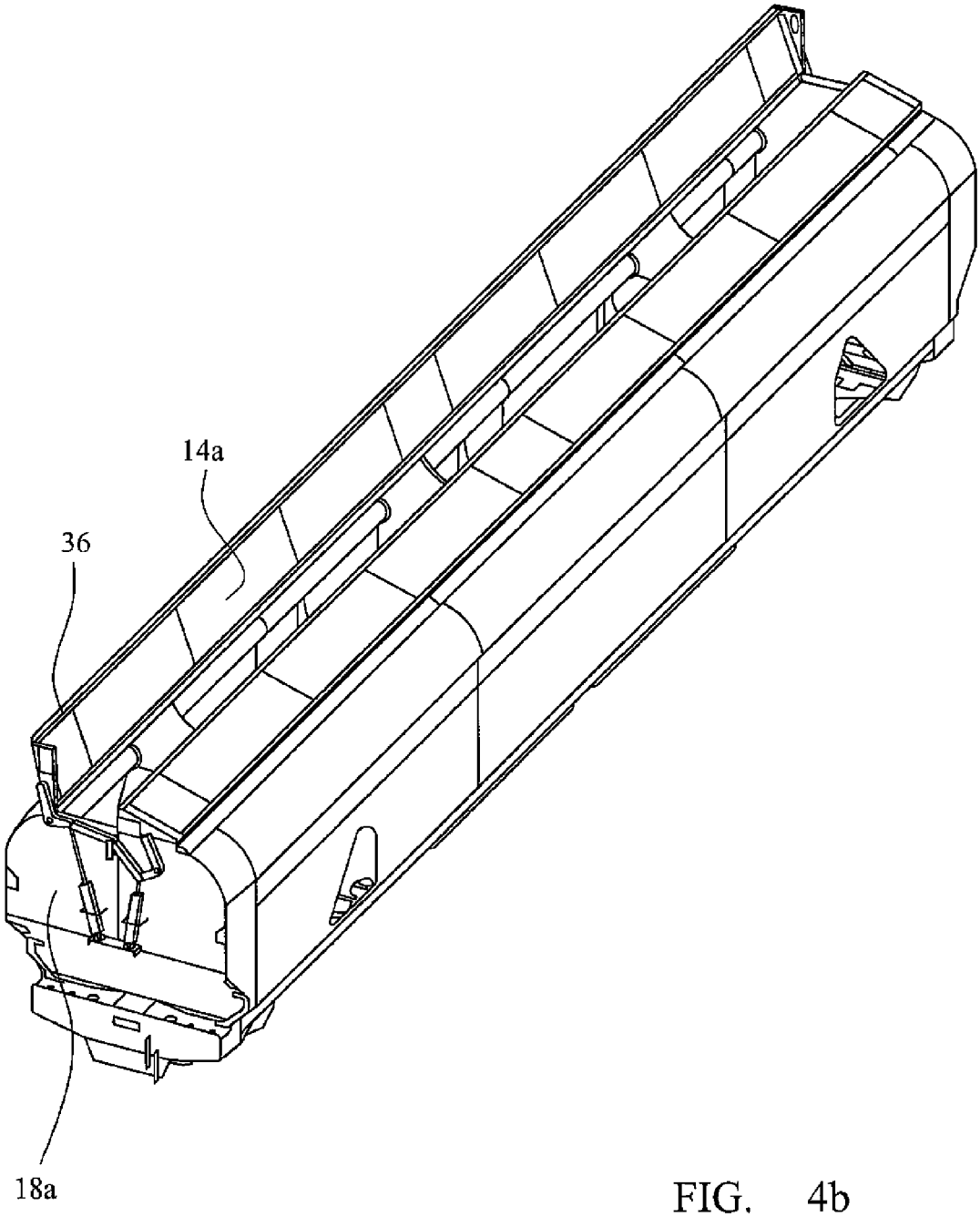

FIGS. 4*a* and 4*b* show the doors a little further in the opening sequence. Door 14*a* is fully open, with the piston rod 24*a* at maximum extension, and door 14*b* has yet to begin to rise.

Figure 5A:
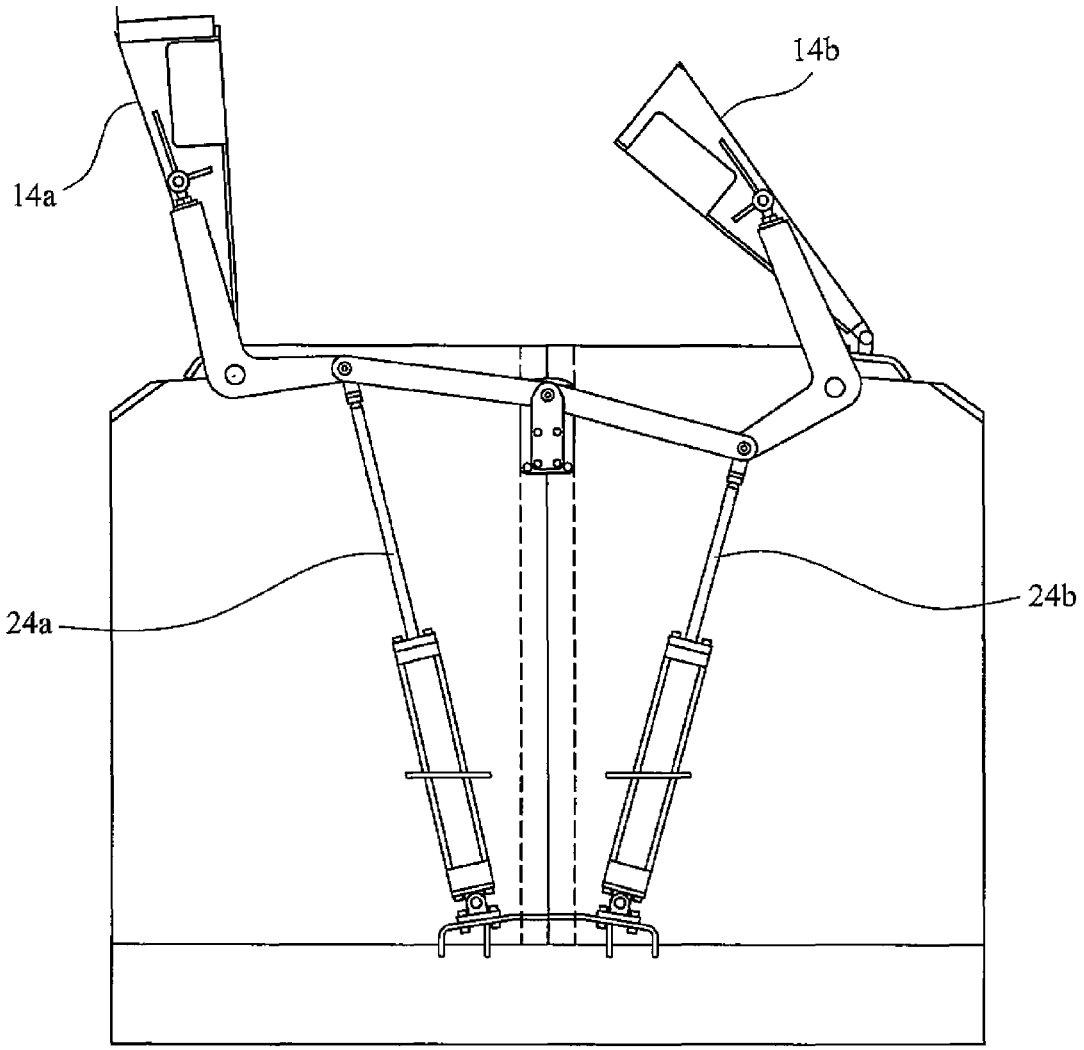
FIGS. 5*a* and 5*b* show the wagon of FIG. 1 respectively in end view and schematic perspective view, with the other of the doors in an intermediate position.
Figure 5B:
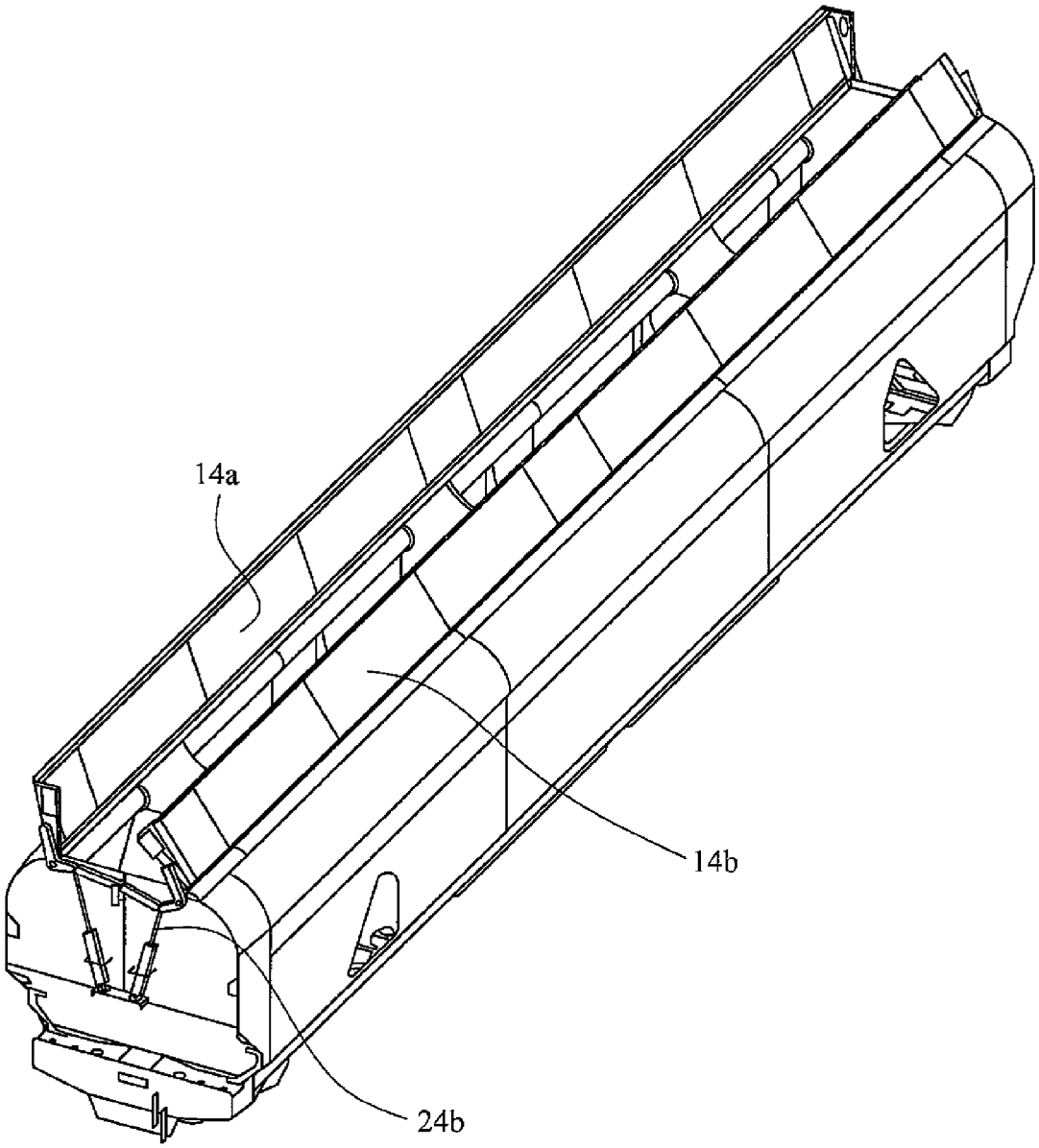

In FIGS. 5*a* and 5*b* door 14*a* remains fully open, and piston rod 24*b* has begun to extend causing door 14*b* to rise.

Figure 6A:
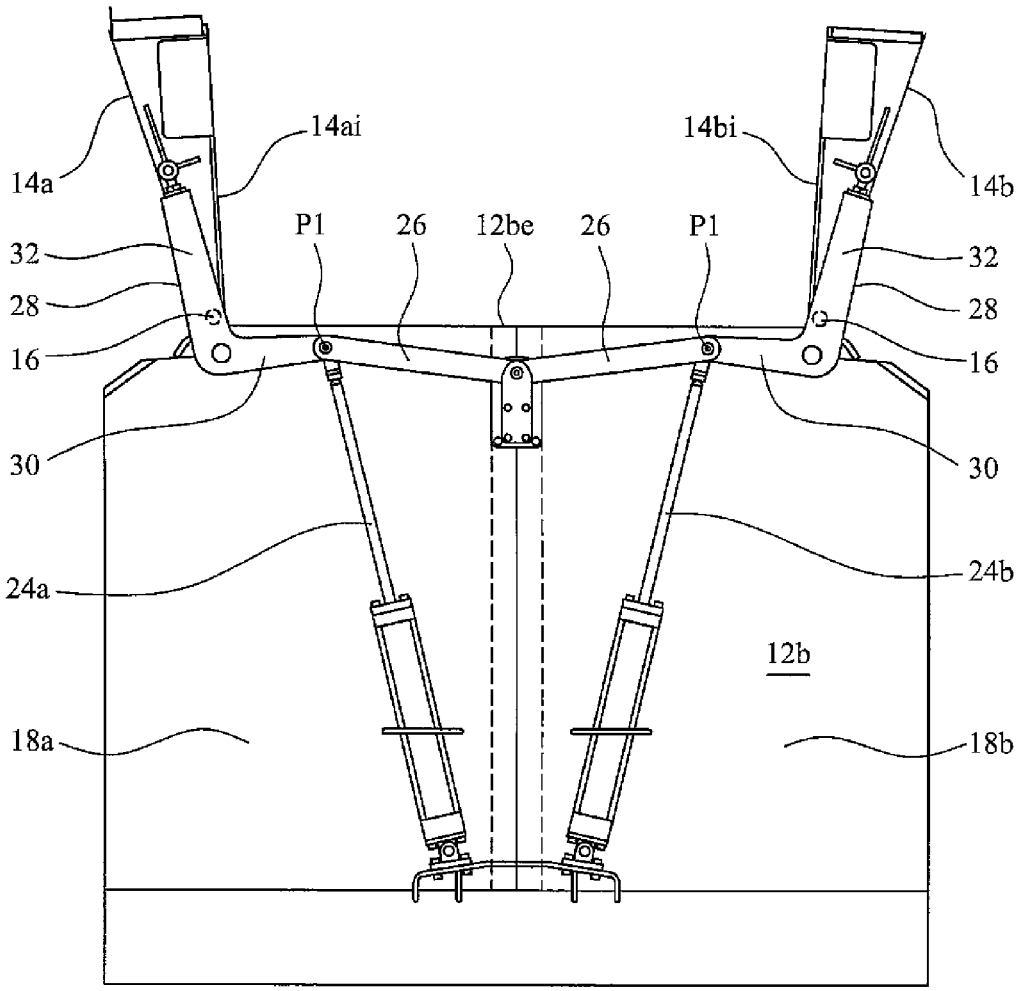
FIGS. 6*a* and 6*b* show the wagon of FIG. 1 respectively in end view and schematic perspective view, with both doors in a fully open position.
Figure 6B:
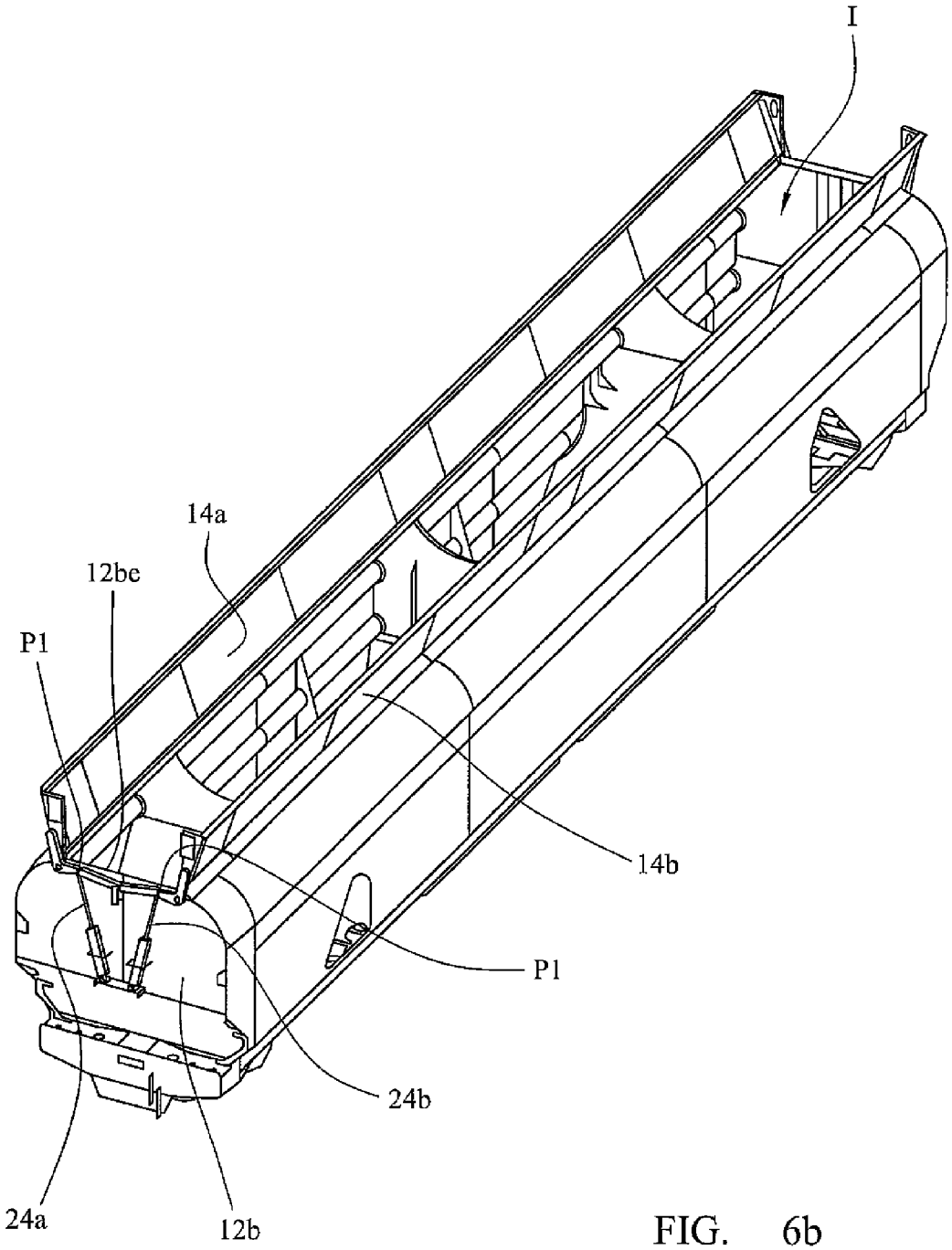

FIGS. 6*a* and 6*b* show doors 14*a* and 14*b* in a fully open configuration. The pivots P1 are both at their maximum height and yet remain below an upper edge 12*be* of end wall 12*b*. The piston rods 24*a* and 24*b* and the straight links 26 also remain below the edge 12*be* of end wall 12*b*, as do the first, lower limbs 30 of the L-shaped links 28. The second, upper limbs of the L-shaped links 28 are positioned beyond inner—i.e. inlet facing—surfaces of the doors 14*ai* and 14*bi*. In this particular embodiment, the second upper limbs extend along a side edge of the door to pivot P3. Due to this geometry, neither the piston rods nor the linkages project into an area above the end wall and between the doors where they would restrict access and/or be potentially vulnerable to damage from contact with bulk material, or with loading apparatus such as a chute or hopper, during loading.

It should be noted that the doors 14*a* and 14*b*, when in this fully open configuration, lie with their centres of gravity slightly beyond their hinges 16, i.e. the doors are said to be "over-centre" and as a result are maintained in the open configuration by gravity until acted upon by the actuators 18*a* and 18*b*.

Operation of the doors is governed by a door control system which may be operated from one of several control panels (not shown), located on either side of the wagon, by an operator. The doors can be operated directly by the operator, or may be operated automatically when the operating system receives an appropriate trigger.

The operation to close the doors is essentially a reverse of the operation to open them, as described above. Door 14*a* must fully open before door 14*b* begins to open, and door 14*b* must be fully closed before door 14*a* begins to close.

The wagon 10 will form part of a freight train comprising several such wagons, typically twenty five in number, arranged to be moved by a locomotive.

When the train enters a loading site an operator arms the door control system from any of the vehicles in the train using an arming key obtained from the site. The train then travels to a loading bay. As each wagon passes a door-activation-device (DADI), e.g. a magnet, located on the loading infrastructure, sensors in the system detect the presence of the DADI and trigger the doors 14*a* and 14*b* to open automatically to receive a payload, for example from a hopper located above the wagon.

As the loaded wagon travels past a second DADI mounted on the loading infrastructure the control system triggers to close the doors. When the doors are fully closed the operator disarms the control system by removing the arming key before the train leaves the loading site.

As an alternative, e.g. in case of power failure, the doors may be controlled manually using operator handles (not shown).

The lower doors (not shown) are operated in accordance with a similar procedure to allow discharging of the payload. The correct timing of the operation of the doors 14*a* and 14*b* is critically important to ensure that payload is not lost, and that the wagons are loaded optimally.

Sensors (not shown) are provided, for example in each of the cylinders 22*a*, 22*b*, to detect at least "door-open" and "door-closed" conditions, to enable precise control of the opening and closing operations, and to permit self-testing by the system. The doors preferably become fully closed, and the sensor detects "door-closed" condition, before the pistons have reached the end of their downward strokes.

The doors 14*a* and 14*b* are primarily maintained in the closed position by gravity. However, in the closed position a secondary locking means may be employed. The secondary locking means may comprise one or more pneumatically actuated blocking valves (not shown) at each of upper and/or lower air inlets on each of the four cylinders. The blocking valves are resiliently biased in the closed position by spring means, and are openable by the application of air pressure, under the pneumatic control of the control system. The blocking valves must be fully open before the pressure is applied to the cylinders 22*a* and 22*b* to open the doors. Similarly, the doors must be fully closed, with each sensor reading a "door-closed" condition, before the blocking valves are allowed to close by reducing the applied air pressure.

When closing the doors, stop members (not shown) are provided against which the doors rest in the closed position, so that the cylinders are not required to bear the weight of the doors in the closed position.

When the operator removes the arming key the wagon reverts to a default mode for transit. A brake interlock function of the wagon detects that the sensors are all showing a "door-closed" condition and that no pneumatic pressure is being applied to the blocking valves. The use of a linkage having a substantially L-shaped or banana-shaped link removes the need for the piston rod or linkage to project above the end wall and inward of the closure member when in the fully open configuration. Hence, the use of L-shaped or banana-shaped link helps to maintain a clear (unobstructed) inlet loading region above the inlet and improves the longevity of the closure system.

The common pivot mount for the linkages is advantageously supported on an upright structural member mounted on the end wall of the wagon. This arrangement obviates the need for a separate sub-frame or other dedicated mounting arrangement, which would undesirably add to the mass of the wagon. Moreover, the upright structural member advantageously enhances the structural integrity of the end wall.

Whilst endeavouring in the foregoing specification to draw attention to those features of the invention believed to be of particular importance, it should be understood that the applicant claims protection in respect of any patentable feature or combination of features referred to herein, and/or shown in the drawings, whether or not particular emphasis has been placed thereon.

Throughout the description and claims of this specification, the words "comprise" and "contain", and any variations of the words, means "including but not limited to" and is not intended to (and does not) exclude other features, elements, components, integers or steps.

Throughout the description and claims of this specification, the singular encompasses the plural unless the context requires otherwise. In particular, where the indefinite article is used, the specification is to be understood as contemplating plurality as well as singularity, unless the context requires otherwise.

Features, integers or characteristics described in conjunction with a particular aspect, embodiment or example of the invention are to be understood to be applicable to any other aspect, embodiment or example described herein unless incompatible therewith.

The invention claimed is:

1. A vehicle having a container body with an inlet and comprising an inlet closure system for covering the inlet of the container body having side walls and at least one end wall, the closure system comprising two closure members arranged substantially above the inlet and moveable between a first closed configuration in which the inlet is substantially closed and a second, fully open configuration in which the inlet is substantially open, and two actuators mounted on the end wall each for moving one of the closure members, wherein the actuators are arranged in use to act upon the closure members via linkages, which linkages are arranged for pivotal motion relative to the end wall about a point substantially midway between the side walls, wherein the linkages comprising first and second links, pivotally connect together, wherein the first links of each linkage are arranged to pivot about a common pivot point, and wherein the common pivot point is located on the end wall at a point substantially midway between the side walls, such that the actuator remains below an upper edge of the end wall when the closure member is in the second, fully open configuration.

2. A vehicle according to claim 1, wherein the actuator is arranged to remain below the upper edge of the end wall throughout substantially the full range of movement of the closure member.

3. A vehicle according to claim 1, wherein the closure members are mounted by a hinge on the side wall.

4. A vehicle according to claim 1, wherein the second link has first and second limbs which meet at a non-straight angle.

5. A vehicle according to claim 4, wherein the first limb of the second link is arranged to lie below the upper edge of the end wall when the closure member is in the second, fully open configuration.

6. A vehicle according to claim 4, wherein the second limb of the second link is arranged to lie substantially beyond an inward facing surface of the closure member when the closure member is in the second, fully open configuration.

7. A vehicle according to claim 1, wherein the actuator comprises a piston.

8. A vehicle according to claim 7, wherein the piston is connected pivotally to the first link.

9. A vehicle according to claim 7, wherein the piston is connected pivotally to the first link and the second link at a common pivot.

10. A vehicle according to claim 9, wherein when the closure member is in the second, fully open configuration the first link is arranged to lie substantially below the upper edge of the end wall.

11. A vehicle according to claim 1, wherein the closure members have proximal edges which are mounted on the side wall in the region of an upper edge of the side wall.

12. A vehicle according to claim 1, wherein the two closure members are mounted on one of two opposed side walls along a proximal edge and arranged to meet at their distal edges to close the inlet.

13. A vehicle according to claim 12, wherein one of the closure members comprises a seal along its distal edge, which seal is arranged to extend over the distal edge of the other closure member in the closed configuration.

14. A vehicle according to claim 1, wherein a first pair of actuators is mounted on opposed end walls and is arranged in use to move one of the closure members, and a second pair of actuators is mounted on opposed end walls and is arranged in use to move another one of the closure members.

15. A vehicle according to claim 1 wherein, the closure members extends substantially between opposed end walls of the body.

16. A vehicle according to claim 1, wherein the actuators comprise pneumatic actuators.

17. An inlet closure system for covering an inlet of a container body having side walls and at least one end wall, the closure system comprising at least one closure member arranged substantially above the inlet and moveable between a first closed configuration in which the inlet is substantially closed and a second, fully open configuration in which the inlet is substantially open, and two actuators mounted on the end wall for moving the closure member, wherein each of the two actuators is arranged in use to move one of the closure members via a linkage, wherein first links of each linkage are arranged to pivot about a common point, wherein the common pivot point is located on the end wall at a point substantially mid-way between the side walls, and wherein the actuator remains below an upper edge of the end wall when the closure member is in the second, fully open configuration.

18. A system according to claim 17, wherein the actuator is arranged to remain below the upper edge of the end wall throughout substantially the full range of movement of the closure member.

19. A system according to claim 17, wherein the closure member is mounted by a hinge on the side wall, and wherein the actuator is connected to the closure member via a linkage.

20. A system according to claim 19, wherein the linkage further comprises second links, and wherein the second link has first and second limbs which meet at a non-straight angle.

21. A system according to claim 20, wherein the actuator comprises a piston, and wherein the piston is connected pivotally to the first link.

22. A system according to claim 21, wherein the piston is connected pivotally to the first link and the second link at a common pivot.

23. A system according to claim 17, wherein there are two closure members, each mounted on one of two opposed side walls along a proximal edge and arranged to meet at their distal edges to close the inlet, and wherein one of the closure members comprises a seal along its distal edge, which seal is arranged to extend over the distal edge of the other closure member in the closed configuration.

24. A system according to claim 17, wherein a first pair of actuators is mounted on opposed end walls and is arranged in use to move one of the closure members, and a second pair of actuators is mounted on opposed end walls and is arranged in use to move another one of the closure members.

25. A vehicle including a container with an inlet and comprising an inlet closure system for covering the inlet of the container body having side walls and at least one end wall, the closure system comprising at least one closure member arranged substantially above the inlet and moveable between a first closed configuration in which the inlet is substantially closed and a second, fully open configuration in which the inlet is substantially open, and two actuators mounted on the end wall for moving the closure member, wherein each of the two actuators is arranged in use to move one of the closure members via a linkage, wherein first links of each linkage are arranged to pivot about a common point, wherein the common pivot point is located on the end wall at a point substantially mid-way between the side walls, and wherein the actuator remains below an upper edge of the end wall when the closure member is in the second, fully open configuration.

26. A vehicle according to claim 25, wherein the actuator is connected to the closure member via a linkage, wherein the linkage further comprises second links, wherein the second link has first and second limbs which meet at a non-straight angle, and wherein the first limb of the second link is arranged to lie below the upper edge of the end wall when the closure member is in the second, fully open configuration.

27. A vehicle according to claim 26, wherein the second limb of the second link is arranged to lie substantially beyond an inward facing surface of the closure member when the closure member is in the second, fully open configuration.

* * * * *